US005772348A

United States Patent [19]

To

[11] Patent Number: 5,772,348

[45] Date of Patent: Jun. 30, 1998

[54] RING BINDER

[75] Inventor: Simon Chun Yuen To, Kowloon, Hong Kong

[73] Assignee: World Wide Stationary Company Limited, Kwai Chung, Hong Kong

[21] Appl. No.: 546,127

[22] Filed: Oct. 20, 1995

[51] Int. Cl.[6] ..... B42F 13/16

[52] U.S. Cl. ..... 402/36; 402/70; 402/73; 402/75

[58] Field of Search ..... 402/80 R, 75, 402/38, 39, 41, 31, 4, 502, 73, 87, 70, 36; D19/27, 32

[56] References Cited

U.S. PATENT DOCUMENTS

| | | | |
|---|---|---|---|
| 813,753 | 2/1906 | Trussell | 402/31 |
| 1,494,626 | 5/1924 | Pitt | 402/36 |
| 1,932,874 | 10/1933 | Adams et al. . | |
| 3,950,107 | 4/1976 | Seaborn | 402/22 |
| 4,697,945 | 10/1987 | Geiger . | |
| 5,035,526 | 7/1991 | Cooper et al. . | |
| 5,100,253 | 3/1992 | Cooper | 402/75 |
| 5,160,209 | 11/1992 | Schuessler . | |
| 5,354,142 | 10/1994 | Yu | 402/41 |
| 5,476,335 | 12/1995 | Whaley | 402/26 |
| 5,577,852 | 11/1996 | To | 402/31 |

FOREIGN PATENT DOCUMENTS

| | | |
|---|---|---|
| 1211335 | 9/1986 | Canada . |
| A3-0 226 297 | 6/1987 | European Pat. Off. . |
| A1-0 312 916 | 4/1989 | European Pat. Off. . |
| A1-0 512 169 | 11/1992 | European Pat. Off. . |
| 19602813 | 8/1996 | Germany . |
| 105206 | 5/1917 | United Kingdom . |
| 1484908 | 9/1977 | United Kingdom . |

*Primary Examiner*—Frances Han
*Attorney, Agent, or Firm*—Pollock, Vande Sande & Priddy

[57] ABSTRACT

A ring binder (100, 200, 300) adapted to be secured to a cover (112, 212, 312) is disclosed as comprising a substantially rigid upper plate member (102, 202, 302) supporting two pivotable lower plates (104*a*, 104*b*, 204*a*, 204*b*, 304*a*, 304*b*) to which a plurality of rings (106, 206, 306) are mounted, and at least a set of claws (108, 208, 308) integrally formed with the ring binder (100, 200, 300) and adapted to secure the ring binder (100, 200, 300) to the cover (112, 212, 312).

9 Claims, 13 Drawing Sheets

RING BINDER

FIELD OF THE INVENTION

This invention relates to a ring binder, and in particular a ring binder adapted to be secured by at least one securing means to a cover.

BACKGROUND OF THE INVENTION

Conventionally, a ring binder is securable to a cover by at least one rivet having a head portion for engagement with the cover and a tail portion which is deformable to engage a recess in the upper part of the ring binder.

A disadvantage associated with such an arrangement is that it is necessary to manufacture and provide the assemblers with both the ring binders and correspondingly shaped and sized rivets suitable for securing the ring binder to the cover. Rivets of a wrong size or shape may be erroneously provided to the assemblers. The assembling process is also laborious and prone to error. In particular, if the riveting action is not properly carried out, the ring binder and/or the cover may be damaged.

It is therefore an object of the present invention to provide a ring binder in which the aforesaid shortcomings are obviated.

SUMMARY OF THE INVENTION

According to the present invention, there is provided a ring binder adapted to be secured to a base member, which ring binder comprises a substantially rigid upper structure supporting a pivotable lower structure to which a plurality of ring members are mounted, characterized in that the ring binder comprises at least one securing means integrally formed with the ring binder and adapted to secure the ring binder to the base member.

Advantageously, the securing means may be integrally formed with the upper structure.

The upper structure may conveniently slope downward at each end.

The securing means may advantageously be deformable to secure the ring binder to the base member.

Conveniently, the securing means may comprise a plurality of deformable securing members, each comprising a pointed element pointing downward from the upper structure.

Advantageously, the pointed elements may depend downward from the periphery of an opening in the upper structure and point outward from the central longitudinal axis of the opening, which may be substantially circular or hexagonal.

BRIEF DESCRIPTION OF THE DRAWINGS

The invention will now be described by way of example with reference to the accompanying drawings wherein:-

DETAILED DESCRIPTION

Figure 1:
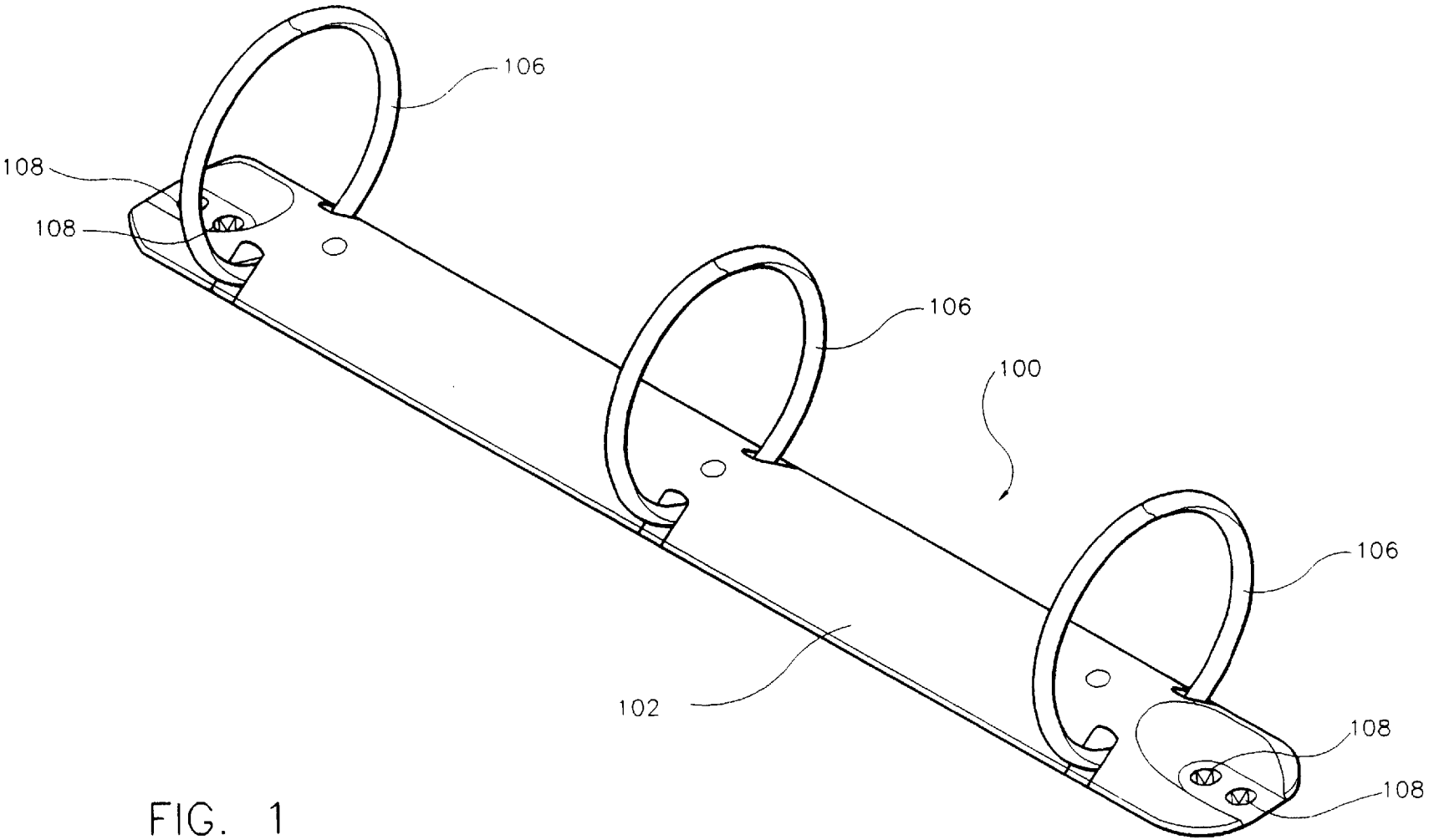
FIG. 1 shows a top perspective view of a first embodiment of a ring binder according to the present invention.
Figure 2:
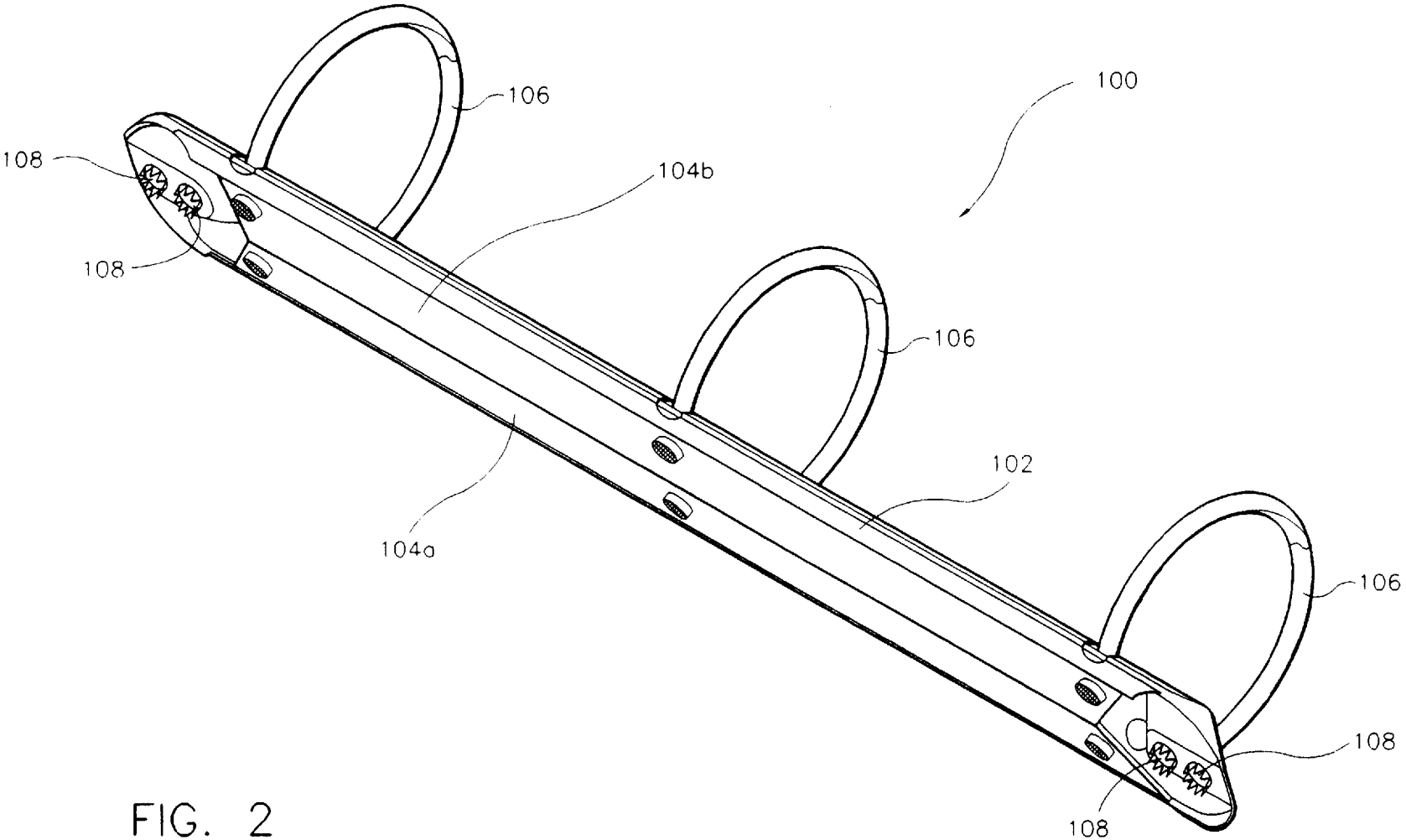
FIG. 2 shows a bottom perspective view of the ring binder shown in FIG. 1.

As shown in FIGS. 1 and 2, a ring binder according to the present invention generally designated as 100 includes a substantially rigid upper plate member 102 supporting a pair of pivotable lower plates 104*a* and 104*b*. The lower plates 104*a* and 104*b* are pivotably movable relative to each other to enable rings 106 to be selectively opened or closed in the conventional manner.

Figure 3:
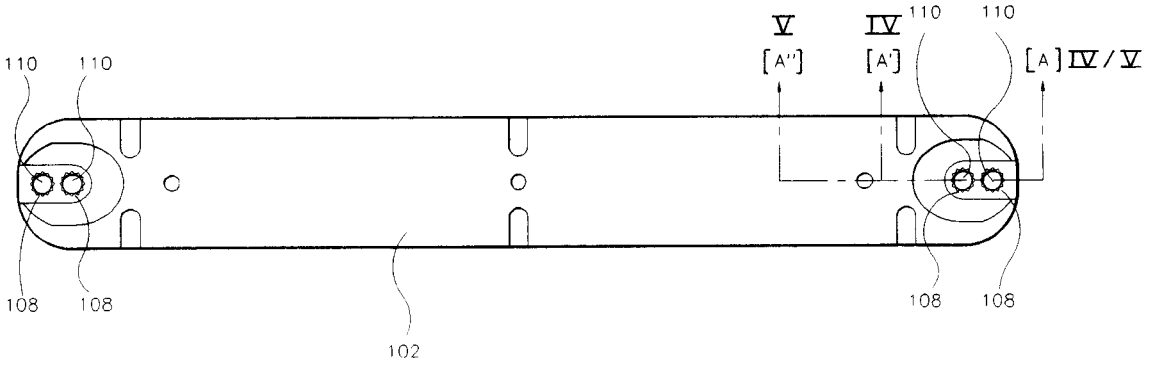
FIG. 3 shows a top view of the ring binder shown in FIG. 1 with the rings removed.
Figure 4:
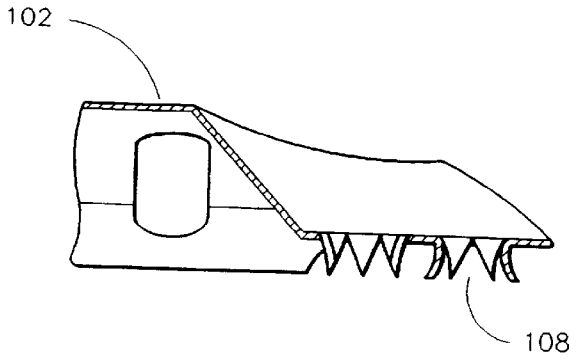
FIG. 4 shows the sectional view along the line IV—IV' of the ring binder shown in FIG. 3.
Figure 5:
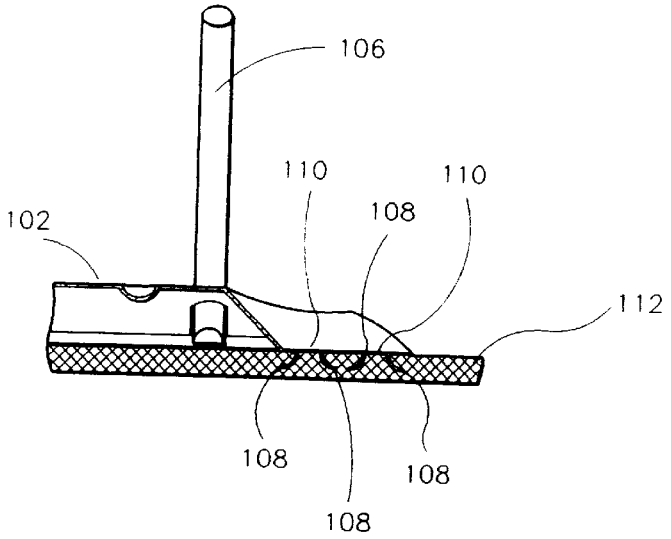
FIG. 5 shows the sectional view along the line V—V' of the ring binder shown in FIG. 3 with rings and as secured to a base member.
Figure 6:
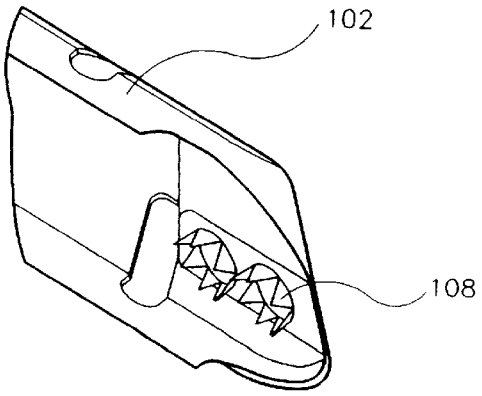
FIG. 6 shows a partial bottom perspective view of the upper structure of the ring binder shown in FIG. 1.

At each end of the ring binder 100 are two sets of claws 108. As shown more clearly in FIGS. 3 to 6, the claws 108 are integrally formed with the upper plate member 102. The claws 108 are pushed out from the upper plate member 102 and apertures 110, shown in FIG. 3 as substantially hexagonal, are formed. The claws 108 extend downward from the upper plate member 102 and outward from the longitudinal axis of the aperture 110. The claws 108 are shown in FIG. 5 as pressed into a, e.g., cardboard cover 112. As the claws 108 are splayed out in the pressing process, the connection between the ring binder 100 and the cover 112 is further enhanced.

Figure 7:
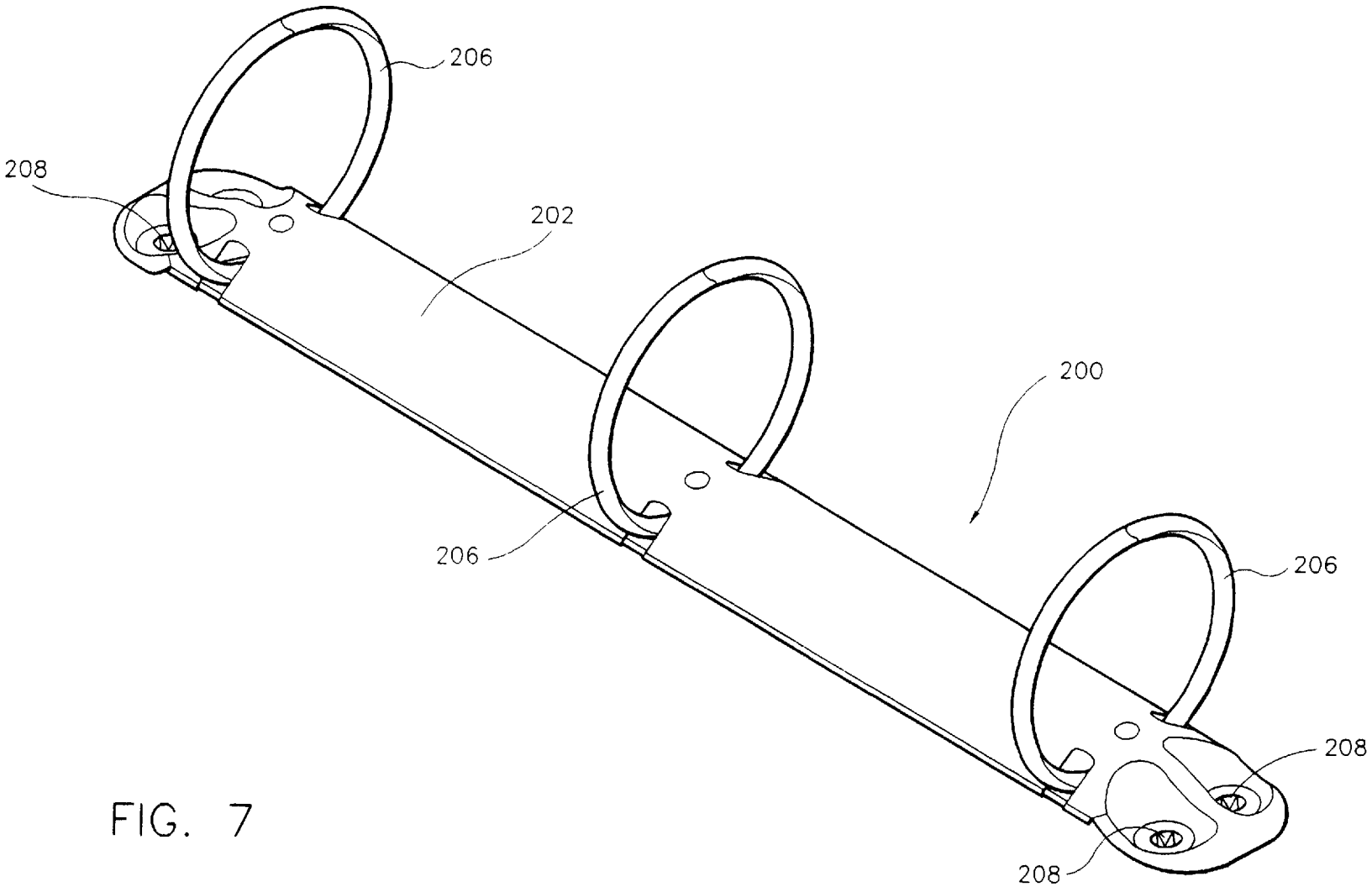
FIG. 7 shows a top perspective view of a second embodiment of a ring binder according to the present invention.
Figure 8:
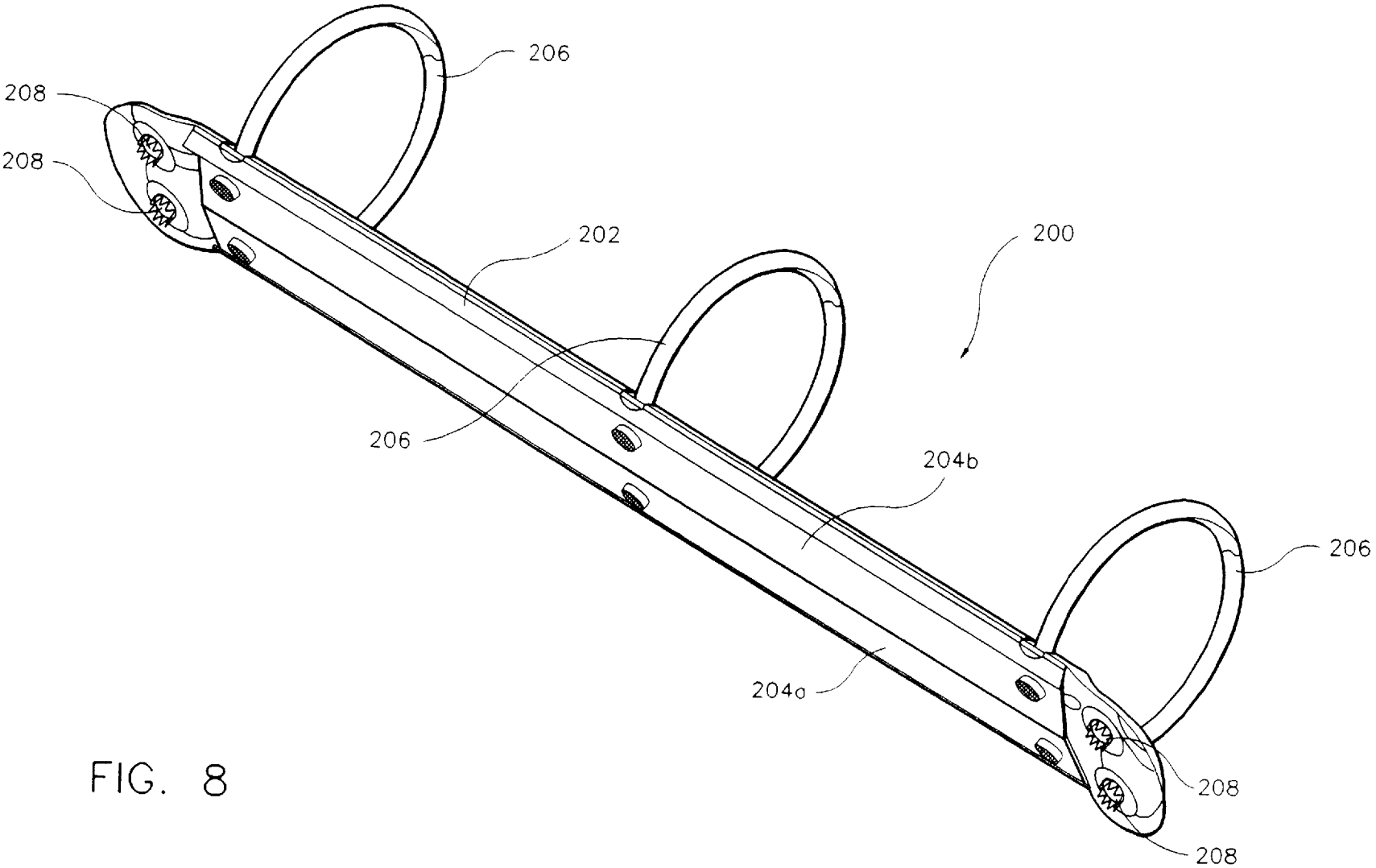
FIG. 8 shows a bottom perspective view of the ring binder shown in FIG. 7.
Figure 9:
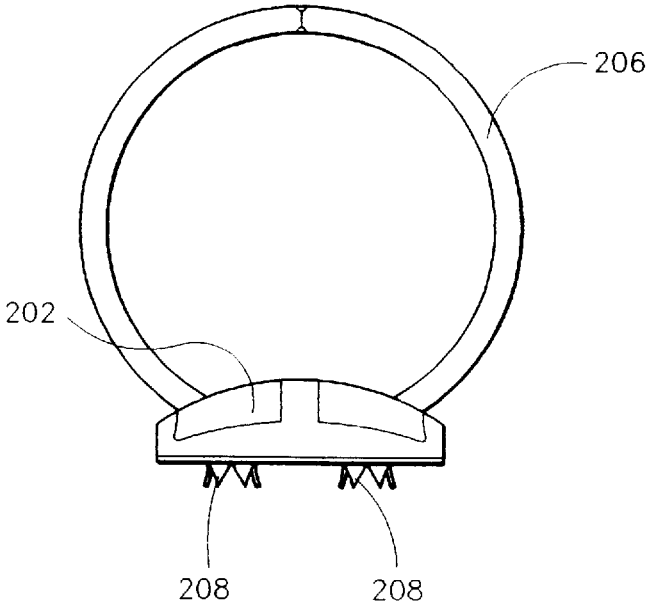
FIG. 9 shows an end view of the ring binder shown in FIG. 7.
Figure 10:
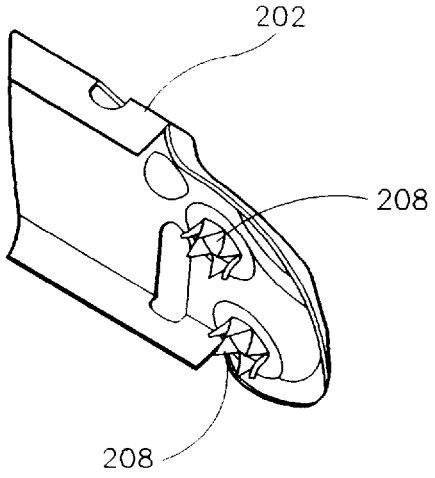
FIG. 10 shows a partial bottom perspective view of the upper structure of the ring binder shown in FIG. 7.

Turning to FIGS. 7 and 8, a second embodiment of a ring binder according to the present invention is shown as generally designated as 200. Similar to the first embodiment described above, the ring binder 200 includes a substantially rigid upper plate member 202 supporting a pair of pivotable lower plates 204*a* and 204*b*. The lower plates 204*a* and 204*b* are pivotably movable relative to each other to enable rings 206 to be selectively opened or closed in the conventional manner.

Figure 11:
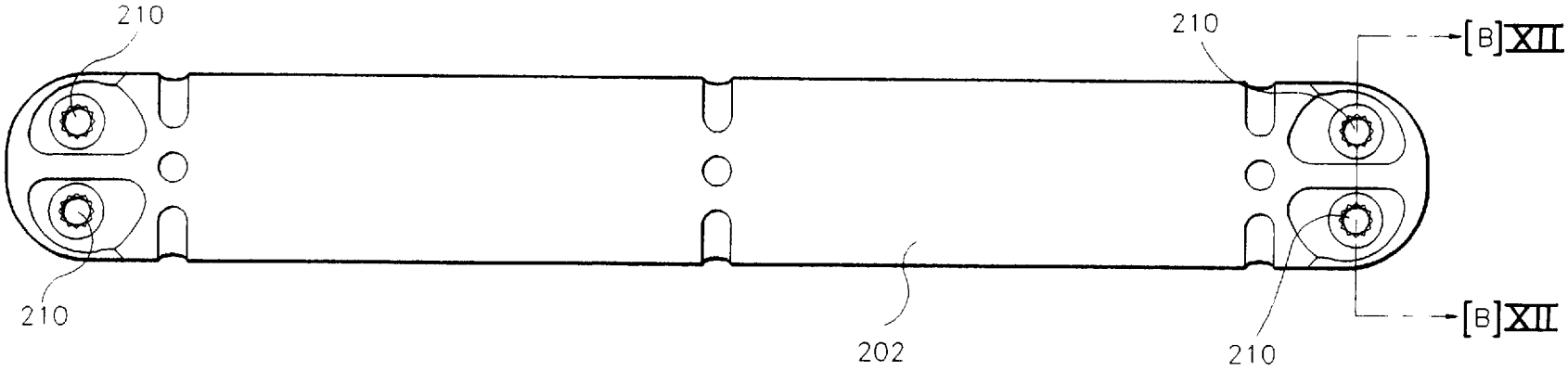
FIG. 11 shows a top view of the ring binder shown in FIG. 7 with the rings removed.
Figure 12:
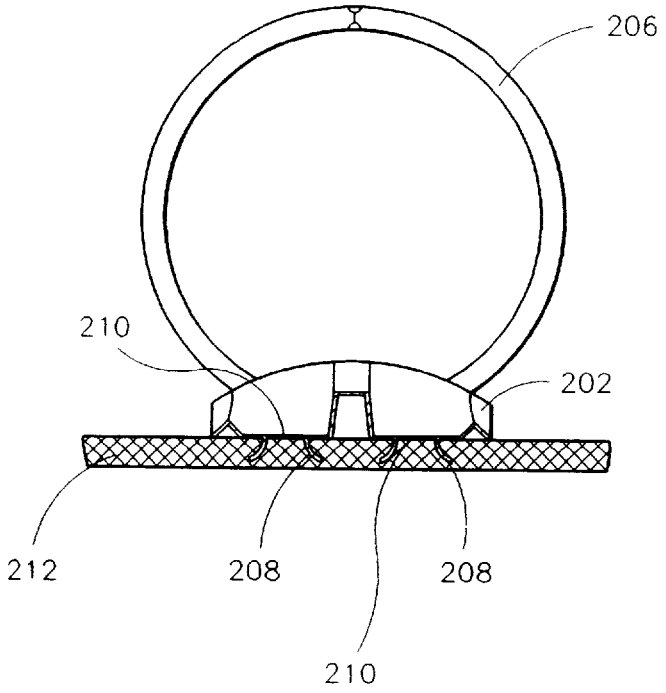
FIG. 12 shows a sectional view along the line XII—XII of the ring binder shown in FIG. 11 with rings and as secured to a base member.

At each end of the ring binder 200 are two sets of claws 208. As shown more clearly in FIGS. 9 to 12, the claws 208 are integrally formed with the upper plate member 202. The claws 208 are pushed out from the upper plate member 202 and apertures 210, shown in FIG. 11 as substantially circular, are formed. The claws 208 extend downward from the upper plate member 202 and outward from the longitudinal axis of the aperture 210. The claws 208 are shown in FIG. 12 as pressed into a, e.g., cardboard cover 212. As the claws 208 are splayed out in the pressing process, the connection between the ring binder 200 and the cover 212 is further enhanced.

Figure 13:
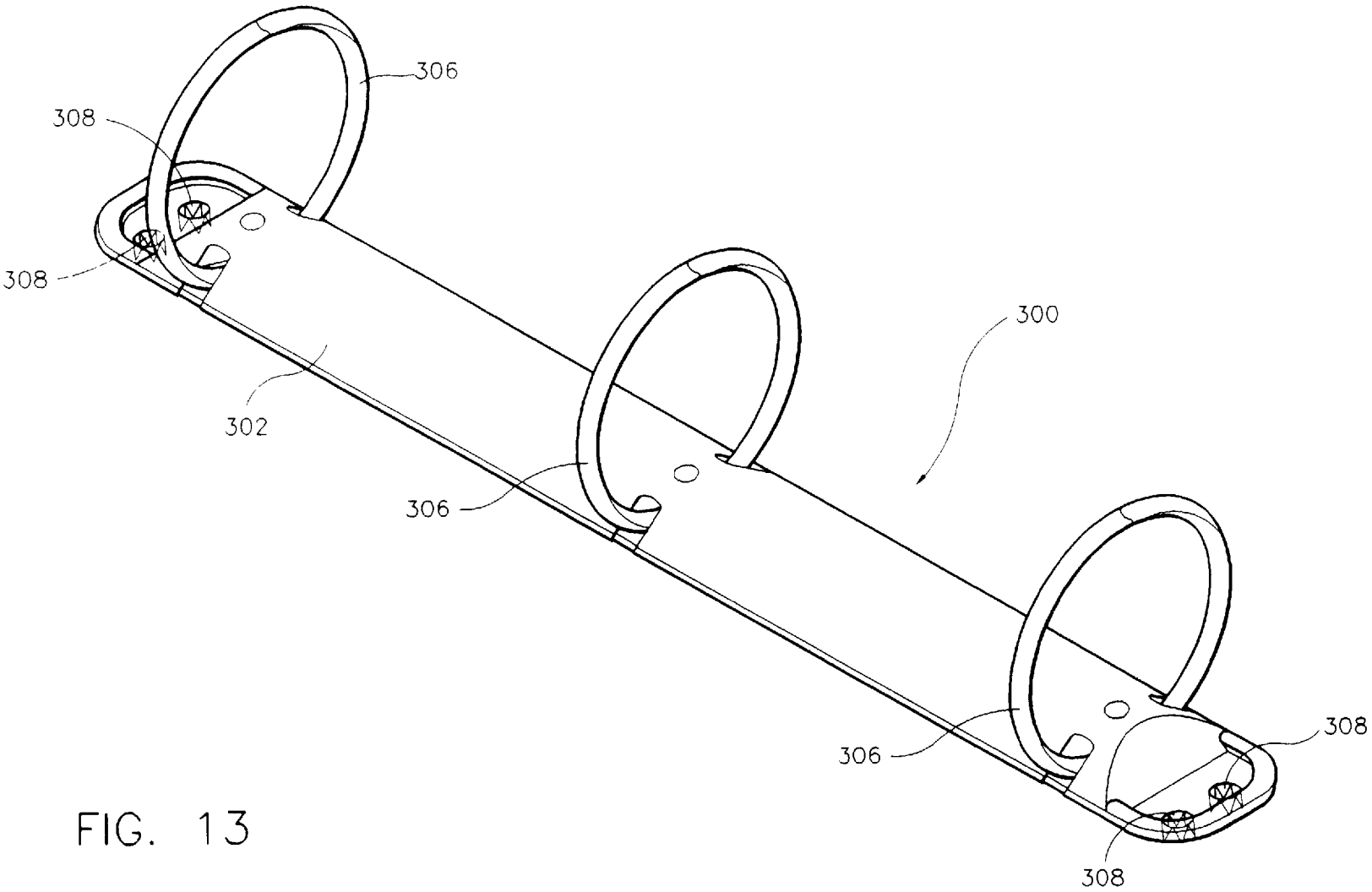
FIG. 13 shows a top perspective view of a third embodiment of a ring binder according to the present invention.
Figure 14:
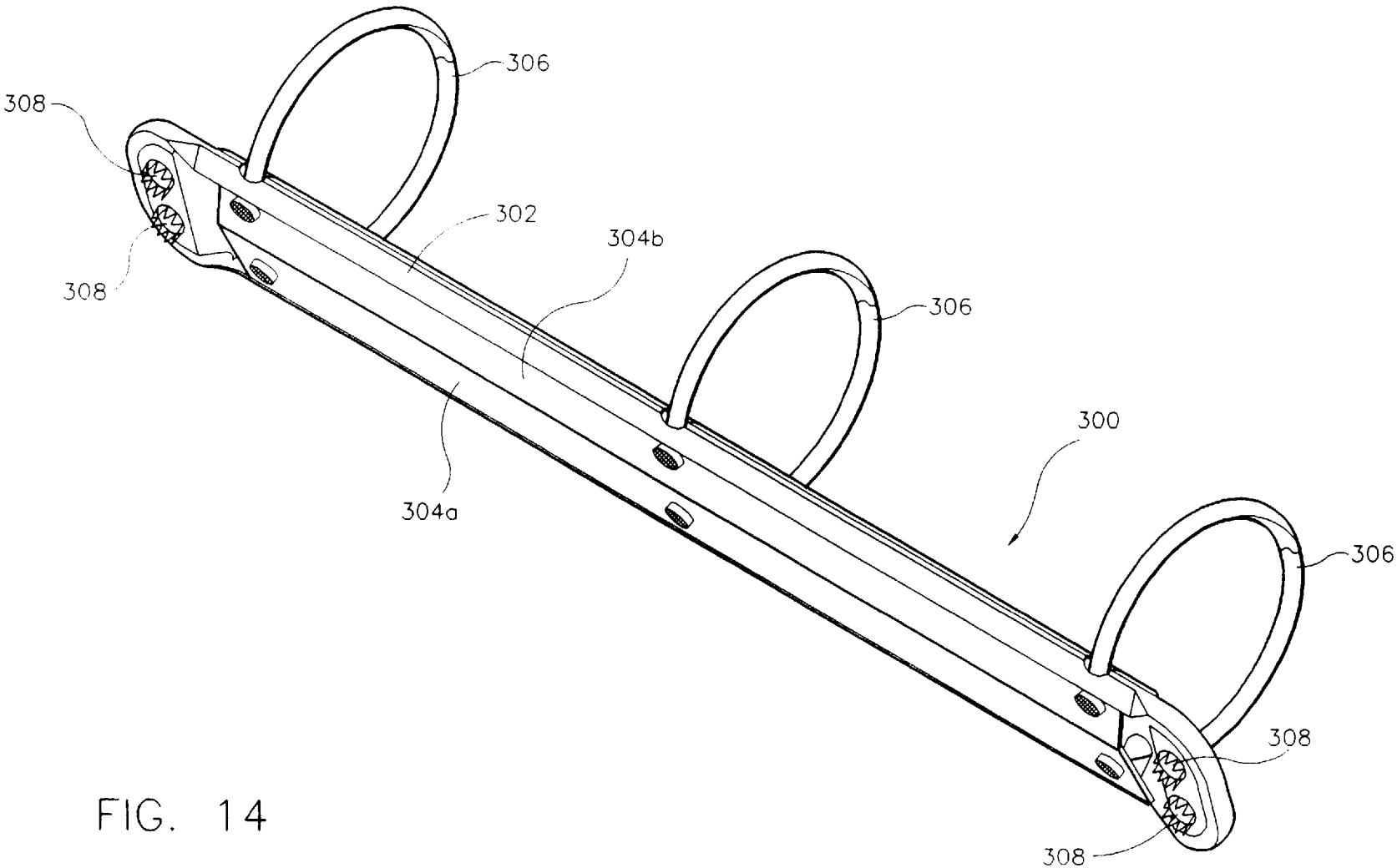
FIG. 14 shows a bottom perspective view of the ring binder shown in FIG. 13.
Figure 15:
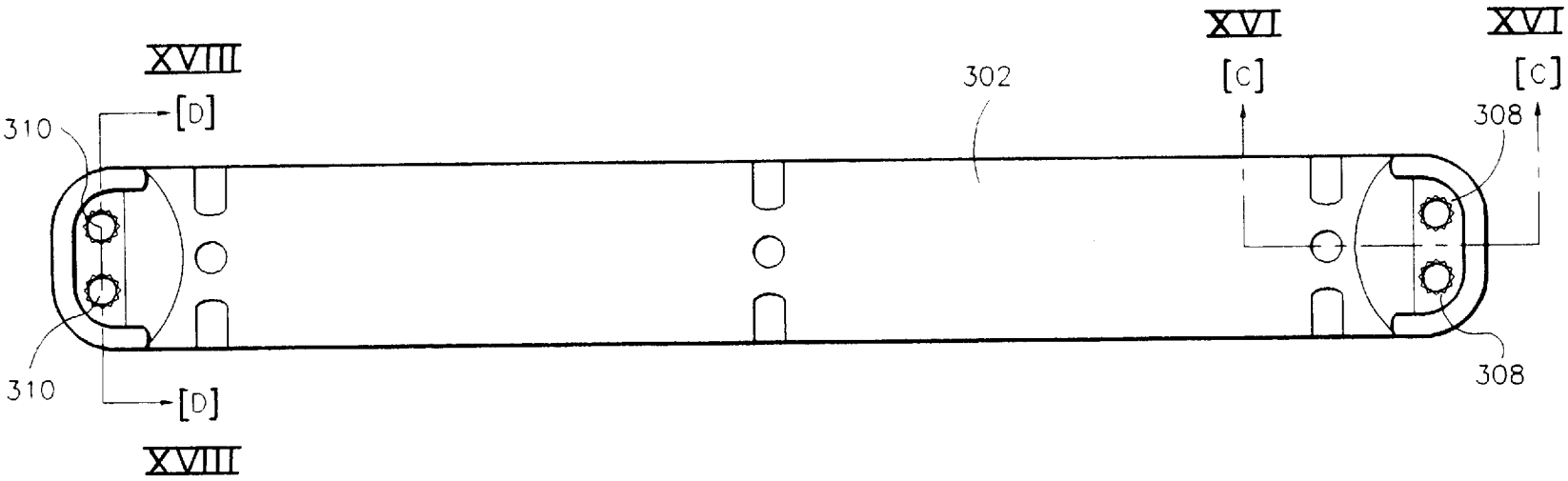
FIG. 15 shows a top view of the ring binder shown in FIG. 13 with the rings removed.
Figure 16:
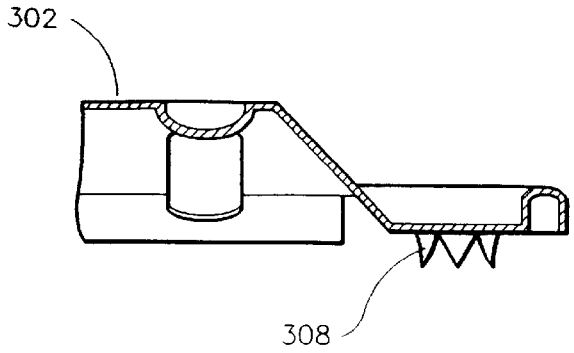
FIG. 16 shows a sectional view along the line XVI—XVI of the ring binder shown in FIG. 15.
Figure 17:
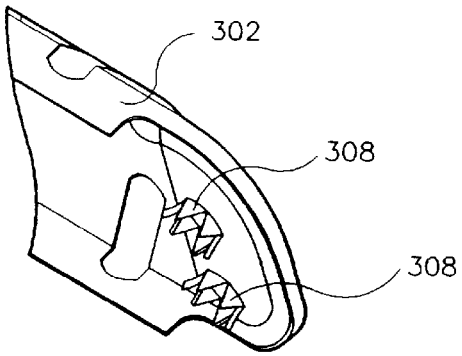
FIG. 17 shows a partial bottom perspective view of the upper structure of the ring binder shown in FIG. 13.

FIGS. 13 and 14 show a third embodiment of a ring binder according to the present invention generally designated as 300. Similar to the two embodiments described above, the ring binder 300 includes a substantially rigid upper plate member 302 supporting a pair of pivotable lower plates 304*a* and 304*b*. The lower plates 304*a* and 304*b* are pivotably movable relative to each other to enable rings 306 to be selectively opened or closed in the conventional manner.

Figure 18:
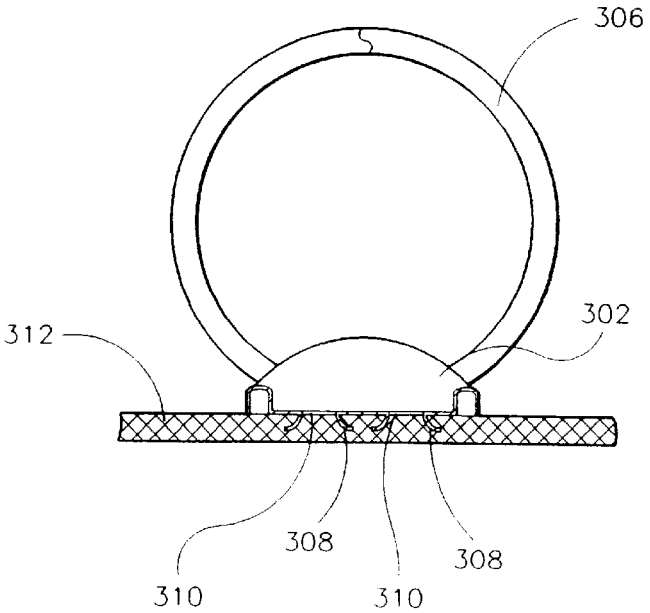
FIG. 18 shows a sectional view along the line XVIII—XVIII of the ring binder shown in FIG. 15 with rings and as secured to a base member.

At each end of the ring binder 300 are two sets of claws 308. As shown more clearly in FIGS. 15 to 18, the claws 308 are integrally formed with the upper plate member 302. The claws 308 are pushed out from the upper plate member 302 and apertures 310 are formed. The claws 308 extend downward from the upper plate member 302 and outward from the longitudinal axis of the aperture 310. The claws 308 are shown in FIG. 18 as pressed into a, e.g., cardboard cover 312. As the claws 308 are splayed out in the pressing process, the connection between the ring binder 300 and the cover 312 is further enhanced.

It is clear from the foregoing that this invention dispenses with the use of any rivet, which necessitates a separate riveting step in the assembling process. The existence of rivets may also hurt workers and/or users. The absence of any rivet on the outer surface of the cover also helps improve the appearance of the cover. It is also found that such an arrangement can withstand a pulling force of 80 lbs. before the ring binder is detached from the cover.

It should be understood that the above only illustrates, by way of examples, ways in which this invention may be performed and that modifications may be made thereto without departing from the spirit of the invention. For example, each end of the ring binder may comprise one or three sets of claws, as different circumstances may require.

I claim:

1. A ring binder adapted to be secured to a base member, said ring binder comprising a substantially rigid upper structure, a pivotable lower structure supported by said upper structure;

a plurality of ring members mounted on said pivotable lower structure;

at least one securing means integrally formed with said upper structure and adapted to extend into at least part of the base member and thereby to secure the ring binder to the base member.

2. A ring binder according to claim 1 wherein the upper structure slopes downward at each end.

3. A ring binder according to claim 1 wherein the securing means is deformable to secure the ring binder to the base member.

4. A ring binder according to claim 1 wherein the securing means comprises a plurality of deformable securing members.

5. A ring binder according to claim 4 wherein the securing member comprises a pointed element pointing downward from the upper structure.

6. A ring binder according to claim 5 wherein the pointed elements depend downward from the periphery of an opening in the upper structure.

7. A ring binder according to claim 6 wherein the pointed elements point outward from the central longitudinal axis of the opening.

8. A ring binder according to claim 6 wherein the opening is substantially circular.

9. A ring binder according to claim 6 wherein the opening is substantially hexagonal.

* * * * *